US006986301B2

(12) United States Patent
Wade

(10) Patent No.: US 6,986,301 B2
(45) Date of Patent: Jan. 17, 2006

(54) PUNCH FOR A DUCTILE MATERIAL JOINING TOOL

(76) Inventor: Colin Maxwell Wade, 12 Boundary Road, Red Lodge, Bury St Edmunds, Suffolk (GB), IP28 8JQ ( * ) Notice: Subject to any disclaimer, the term of this patent is extended or adjusted under 35 U.S.C. 154(b) by 97 days.

(21) Appl. No.: 10/365,073

(22) Filed: Feb. 12, 2003

(65) Prior Publication Data

US 2003/0154833 A1 Aug. 21, 2003

(30) Foreign Application Priority Data

Feb. 20, 2002 (GB) ..... 0203946

(51) Int. Cl.
*B26F 1/14* (2006.01)

(52) U.S. Cl. ..... 83/684; 83/687; 83/955

(58) Field of Classification Search ..... 83/684, 83/685, 687, 955, 686
See application file for complete search history.

(56) References Cited

U.S. PATENT DOCUMENTS

| | | | | |
|---|---|---|---|---|
| 2,765,848 A | * | 10/1956 | Bakula | 83/693 |
| 4,375,774 A | | 3/1983 | Wilson et al. | |
| 4,910,853 A | | 3/1990 | Sawdon | |
| 5,208,973 A | | 5/1993 | Sawdon | |
| 5,267,383 A | | 12/1993 | Sawdon | |
| 5,291,814 A | * | 3/1994 | Fierkens | 83/955 |
| 5,317,894 A | | 6/1994 | Southard | |
| 5,848,621 A | * | 12/1998 | Cheung | 83/955 |
| 6,612,007 B1 | * | 9/2003 | Wade | 29/243.5 |
| 6,760,963 B2 | * | 7/2004 | Wade | 83/955 |
| 6,871,673 B2 | * | 3/2005 | Crittenden | 83/955 |

FOREIGN PATENT DOCUMENTS

| | | |
|---|---|---|
| GB | 2334474 | 8/1999 |
| GB | 2369316 | 5/2002 |
| GB | 2369317 | 5/2002 |
| SU | 1618628 | 9/1991 |

OTHER PUBLICATIONS

EPO—European Search Report, Apr. 10, 2003.

* cited by examiner

*Primary Examiner*—Allan N. Shoap
*Assistant Examiner*—Jason Prone
(74) *Attorney, Agent, or Firm*—Devine, Millimet & Branch; Paul C. Remus; Michelle Saquet Temple

(57) ABSTRACT

The present invention relates to a punch (30) and punch assembly (2) for use in a tool (1) for joining ductile materials, such as metal sheets (7,8), in a lance joint or a clinch joint. The punch (30) has a punch body (31) formed around a punch axis (5). Two punch tips (34,34') extend in opposite directions from the punch body (31) along the punch axis (5). The punch body has one or more load engagement features (41,41') by which a punch force for joining the ductile materials (7,8) is imparted to the punch body (31). When one punch tip (34) becomes worn, the punch (30) can be removed from a punch holder (25), inverted and rejoined to the punch holder (25) so that the other of the punch tips (34') can be used to join ductile material (7,8)

24 Claims, 5 Drawing Sheets

PUNCH FOR A DUCTILE MATERIAL JOINING TOOL

BACKGROUND a. Field of the Invention

The present invention relates to a punch for use in a tool for clinch joining ductile materials, such as metal sheets, and in particular to a punch for use with a lanced clinch joiner or a round clinch joiner.

b. Related Art

It is known to join a plurality of sheets of ductile material by causing these to be deformed into an interlocking configuration in a local area. Such joins are made by ductile material joining tools comprising a die with an aperture that is opposite a punch assembly comprising a punch. The punch has a punch tip, which may have a flat or rounded punch surface. The edges of the punch surface may be radiused, chamfered, or sharp. The punch itself may be surrounded by a stripper mechanism to facilitate removal of the punch from the deformed ductile material. Layers of ductile material are sandwiched between the punch assembly and when the punch tip punch is pressed towards the aperture, material is drawn into the aperture. The material undergoes plastic deformation in the aperture to flow into a shape in which two or more layers are interlocked, for example by the forming of one layer around another layer.

The die aperture normally has a base with an anvil having an anvil surface and at least two side walls formed from movable blades. The blades are generally transverse to the anvil surface and extend in the direction in which the die and punch are pressed together. The blades help define the local area, for example a circular, square or rectangular area, in which the deformation of the layers of sheet material takes place. Once the material has been drawn and flows into the aperture, the blades move away from each other in a radial direction as the sheet material is compressed it flows laterally. Some types of die blade pivot outwards about a pivot mechanism below the level of the anvil surface. The pivot mechanism has a pivot axis or pivot point below and laterally outside an edge of the anvil surface.

A circular die and punch can be used to form a clinch joint in which sheet material is symmetrically deformed both axially and radially to form a leak-proof button, for example as disclosed in patent documents U.S. Pat. No. 5,150,513 and EP 1 055 467 A2. A square or rectangular die and punch can be used to form a trapezoidal clinch joint (also called a lance joint), in which the sheet material is cut through by the punch along a pair of parallel opposed lines, with the layers of sheet material deformed laterally outwards underneath each of the cuts, as disclosed in patent document GB 2,334,474. The present invention relates a punch for forming these and other types of joints in layers of ductile material.

The lifetime of a punch assembly is limited essentially by wear of the punch tip, either of the punch surface itself or edges to the punch tip. Such wear can be minimised if the punch tip is made from hardened steel (62 to 64 RC), but this increases the possibility of the punch tip breaking if the punch is not properly aligned with the die. The clearance between the punch tip and die blades for a lanced joint is normally very close, for example of the order of 50 $\mu$m for a 3 mm width punch tip used to join two pieces of 0.7 mm thick metal. The punch tip may therefore be damaged in use if it is not properly aligned with the die.

The corner of the die blade facing inwards to the die recess normally forms a sharp edge of about 90°, but this will become dull with excessive use. When clinch joining hard metals, such as stainless steel, the lifetime of a die blade may be as short as 10,000 to 20,000 cycles. In order to maintain join quality, it is necessary to keep to a conservative schedule for changing die blades, which adds to manufacturing cost.

When a punch tip becomes worn or damaged, the punch can be removed from the punch assembly and replaced with a new punch. However, because the punch is made from precision machined and hardened steel, each punch is relatively expensive. In addition, a stock of new punch tips may have to be maintained in order to avoid disruption in a production environment. The need to maintain a stock of punches adds to manufacturing cost, particularly if more than one type of punch is to be used with a particular punch assembly.

It is an object of the present invention to provide a more convenient punch for use in a tool for joining ductile materials.

SUMMARY OF THE INVENTION

According to the invention, there is provided a punch for use in a tool for joining ductile materials, comprising a punch body formed around a punch axis, two punch tips extending in opposite directions from the punch body along the punch axis, each punch tip having a punch surface that extends transversely to the punch axis, wherein the punch body has one or more load engagement features by which a punch force for joining ductile materials may be imparted to the punch body along the punch axis so that one or the other of the punch tips may bear against said ductile material.

The invention therefore provides a punch that may be used in such a way that the punch force is not borne by the punch tip not in use.

The invention also provides a punch assembly for use in a tool for joining ductile materials, comprising a punch, and a punch holder to which the punch may be removably secured, the punch being according to the invention and the punch holder having a load application feature that in use imparts via the load engagement feature said force to the punch body along the punch axis, wherein the punch can be removably secured to the punch holder in either a first orientation or alternatively in a second orientation to dispose respectively one or the other of the punch tips for use to join ductile materials by application of said imparted force along the punch axis.

The invention further provides a ductile material joiner for joining two or more layers of ductile material, for example in a round clinch joint or in a lanced clinch joint, comprising a die and a punch assembly with a punch tip disposed in use towards the die, wherein the die has a die aperture matching the punch tip, and the punch assembly is according to the invention.

The invention provides cost savings in manufacture of the punch, compared with two conventional punches that each have just one punch tip. This is because it is easier and quicker to fabricate two oppositely directed punch tips on a single punch body, rather than two such tips on different bodies. In addition, because such punch tips normally undergo a final hardening and plating process, cost is saved by halving the number punches which have to hardened and plated.

The punch holder may have a recess, for example a cylindrical bore, so that when the punch is secured to the punch holder in either the first orientation or the second orientation, one of said punch tips is retained within the recess while the other of the punch tips may be used to join ductile materials.

The punch tips, particularly if the tips are hardened, could be damaged by forces exerted in use by the punch holder. Because such forces are borne by the load engagement feature, rather than the punch tip not in use, the unused punch tip is thereby protected from wear or damage.

The load engagement feature may be any feature suitable for transmitting forces used in joining ductile material, for example a projection from the punch body, or a recess in the punch body. In the preferred embodiments of the invention, the load engagement feature is one or more shoulders on the punch body. Such shoulders may be a step in the outer profile of the punch, a protruding flange, or a step in the punch body. The or each shoulder may extend transversely, at least to some extent, from the punch axis.

In a preferred embodiment of the invention, a first shoulder and a second shoulder each extend perpendicularly to the punch axis. The shoulders are arranged so that in use a force may be applied either to one of the said shoulders to cause the punch to exert a pressure or to move in a first direction along the punch axis, or to the other of said shoulders to cause the punch to exert a pressure or move in a second direction along the punch axis.

When the punch tips face in directly opposite directions, the punch when secured to the punch holder in the first orientation is 180° rotated with respect to the punch when secured to the punch holder in the second orientation.

Preferably, the assembly comprises a load spacer which extends between the load engagement feature and the load application feature when the punch is secured to the punch holder. The dimension of the load spacer along the punch axis may be altered, either by fitting a different load spacer to the punch assembly or, for example, by grinding down the length of the load spacer. Such an adjustment is useful in order to vary the length and therefore stoke and pressure exerted by the punch tip.

In the preferred embodiments of the invention, the load engagement feature is a shoulder surrounding the punch tip within said recess, the punch tip having one or more side walls extending from the shoulder to the punch surface, and the load spacer having a clearance fit with the or each punch side wall.

The load spacer may also be used to help adjust or to set a correct rotational orientation of the punch relative to the punch holder or assembly. In one embodiment of the invention, the load spacer may have a projection that extends transverse to the punch axis to facilitate the making of said adjustment to the rotational orientation of the load spacer.

Preferably, the load spacer has one or more location features that are located with one or more matching features of the punch so that the rotational orientation of the punch about the punch axis may be adjusted by making a corresponding adjustment to the rotational orientation of the load spacer.

If the punch body has an essentially circular cross-section in a plane perpendicular to the punch axis then, prior to being secured to the punch holder, the punch may be rotated about the punch axis with respect to the punch holder. If at least one of the punch tips has a non-circular cross-section, for example a square or rectangular cross-section, in a plane perpendicular to the punch axis, the rotational orientation of said non-circular cross-section may then be adjusted by rotating the punch about the punch axis prior to securing the punch in the punch holder.

The invention further provides a method of servicing a punch assembly for use in a tool for joining ductile materials, when the punch assembly is according to the invention, the method comprising the steps of:

i) removing the punch from the punch holder when the one of said punch tips disposed for use to join ductile materials has become worn or damaged;

ii) returning the punch to the punch holder with the relative orientation of the punch to the punch assembly altered so that the other of said punch tips is disposed for use to join ductile materials.

BRIEF DESCRIPTION OF THE DRAWINGS

The invention will now be described in further detail, by way of example to the accompanying drawings, in which.

DETAILED DESCRIPTION

Figure 1:
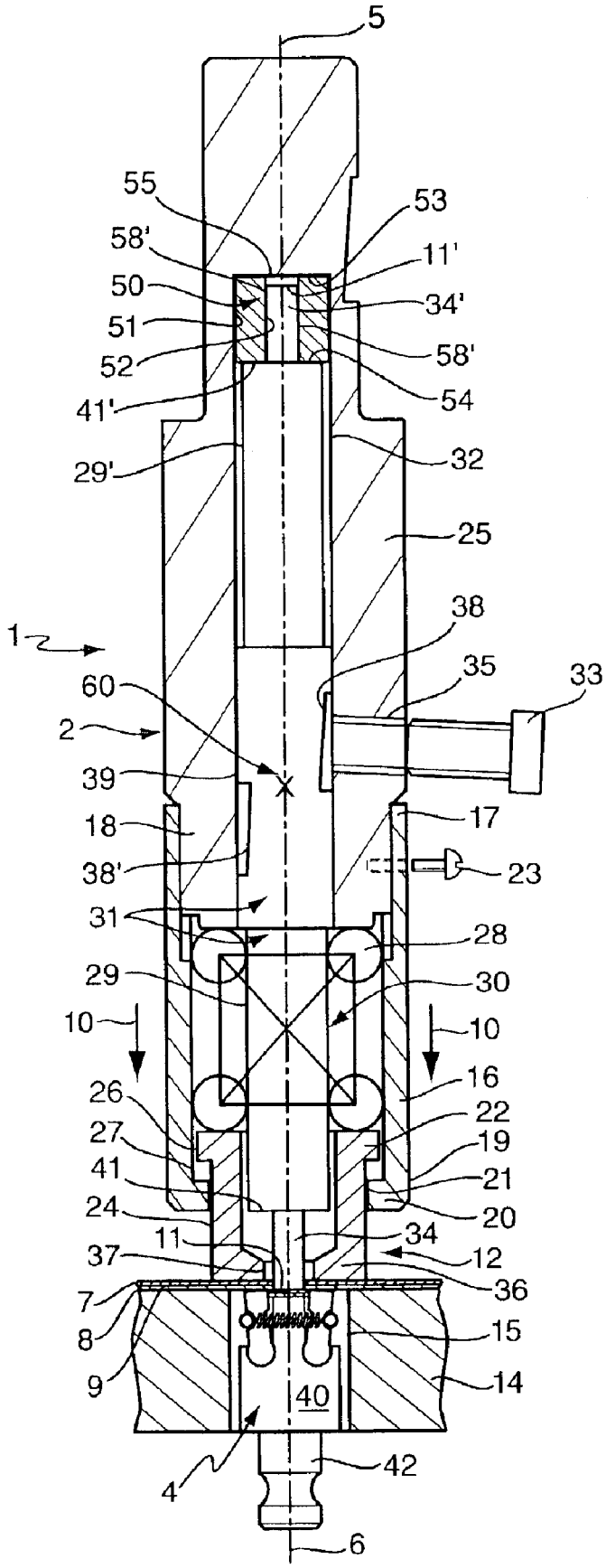
FIG. 1 is a partial cross-section view of a ductile material joiner according to a first embodiment of the invention, for joining two or more layers of ductile material, comprising a die and a punch assembly with a punch tip disposed in use towards the die while being used to form a lanced joint in two sheets of ductile material.

FIG. 1 shows a first embodiment of a ductile material joiner 1 according to a first embodiment of the invention. The joiner comprises a punch assembly 2 and a die assembly 4. The punch assembly 2 and die assembly 4 are aligned along common punch axes 5,6. Between the punch assembly 2 and die assembly 4 are a pair of thin ductile metal sheets 7,8 which are aligned transverse to the punch axes 5,6. The sheets 7,8 are in contact along a common interface 9.

In a sheet material joining operation, the punch assembly 2 is brought towards the pair of sheets 7,8 along a longitudinal direction as indicated by movement arrows 10 until a forward hollow stripper tip 12 of the punch assembly 2 comes into contact with an upper one of the metal sheets 7, thereby pressing the other lower metal sheet 8 against a base plate 14 surrounding the die assembly 4. The base 14 plate has a recess 15 in which the die assembly 4 is removably seated.

The punch assembly 2 has a lower cylindrical housing 16 referred to herein as a stripper can. The part of the stripper can 16 away from the metal sheets 7,8 has an open end 17 within which an open end 18 of a generally cylindrical punch holder 25 is secured by means of a set screw 23. The other end 19 of the stripper can 16 has a radially inwards directed lip 20 which terminates in a central circular aperture 21 from which the stripper tip 12 extends. The stripper tip 12 has an outwardly directed flange 22 inside the stripper can 16. An outer cylindrical surface 24 of the stripper tip 12 is a close sliding fit with the matching cylindrical aperture 21 of the stripper can lip 20. In addition, the stripper tip flange 22 has an outer cylindrical surface 26 which has a close sliding fit with an inner cylindrical surface 27 of the stripper can 16. The stripper tip 12 is therefore free to slide axially with respect to the stripper can 16 along the longitudinal direction 10.

The sliding fit of the stripper tip 12 within the stripper can 16 is limited in an outwards direction by contact between the stripper can lip 20 and the stripper tip flange 22. A coil spring 28, shown schematically in FIG. 1, is retained within the stripper can 16 between the punch holder 25 and the stripper tip flange 22. The coil spring 28 biases the stripper tip 12 outwards so that in a rest condition the stripper tip flange 22 remains in contact with the stripper can lip 20. The axial sliding movement of the stripper tip 12 with respect to the stripper can 16 is limited in an axially inwards direction by compression of the spring 28 against the punch holder 25.

A double-ended punch 30 is axially centered on the punch axis 5. The punch 30 has a body portion 31 with a cylindrically stepped outer surface, a lower and upper third of which 29,29' have the same dimensions with a reduced diameter compared with a central third 39. The central portion 39 of the punch body 31 makes a tight siding fit inside a cylindrical bore 32 of the punch holder 25. The punch 30 is secured to the punch holder 25 by a securing bolt 33 that is threaded through a tapped hole 35 in the punch holder 25 to engage with a flat 38 on the central portion 39 of the punch body 31, so that the punch 30 extends axially inside the punch holder 25 and along the centre of the stripper can 16 into the stripper tip 12.

The upper and lower thirds 29,29' of the punch body 31 each terminate at a right-angled shoulder 41,41', in the form of a surface that extends inwardly towards a rectangular (or square) punch tip 34,34'. The shoulders 41,41' therefore define respective boundaries between the punch body and the punch tips 34,34', and the shoulder at each boundary extends in a ring around the respective punch tip 34,34'. Each punch tip 34,34' is unitary with the punch body and extends from the punch body 31 in opposite directions centered along the punch axis 5, and each has a flat punch surface 11,11' that extends perpendicularly to the punch axis 5.

One punch tip 34 protrudes in use through the stripper tip 12, while the other punch tip 34' is concealed within the cylindrical bore 32 of the punch holder 25. The concealed punch tip 34' is partially surrounded by a load spacer 50, which has an outer surface 51 matching the width of the bore 32, and a rectangular inner surface 52 matching rectangular side walls 58' of the punch tip 34'. The load spacer has parallel upper and lower surfaces 53,54 that contact respectively a flat end surface 55 of the bore 32 and the shoulder 41' surrounding the punch tip 34'. The spacing between the parallel upper and lower surfaces 53,54 of the load spacer 50 is greater than the extension of the punch tip 34' from the shoulder 41', so that the punch surface 11' of the concealed punch tip 34' is free from contact with any surfaces within the punch holder 25. This helps to protect the concealed punch surface 11' from damage or wear.

The stripper tip 12 terminates in a neck 36 with a rectangular inner surface 37 that has a clearance fit with the rectangular side walls 58 of the protruding punch tip 34.

The operation of the punch assembly 2 to join ductile material 7,8 will now be described. When the punch assembly 2 is moved 10 up against the metal sheet 7 the stripper tip 12 comes first into contact with the upper metal sheet 7. Further movement 10 then causes the stripper tip 12 to slide axially with respect to the stripper can 16, with the result that the spring 28 begins to be compressed whilst the protruding punch tip 34 continues with the motion 10 towards the metal sheet 7.

As this is happening, the base 14 plate and the die assembly 4 provide a restoring force against the other metal sheet 8. Most of the restoring force is provided through the die base plate 14.

Figure 2:
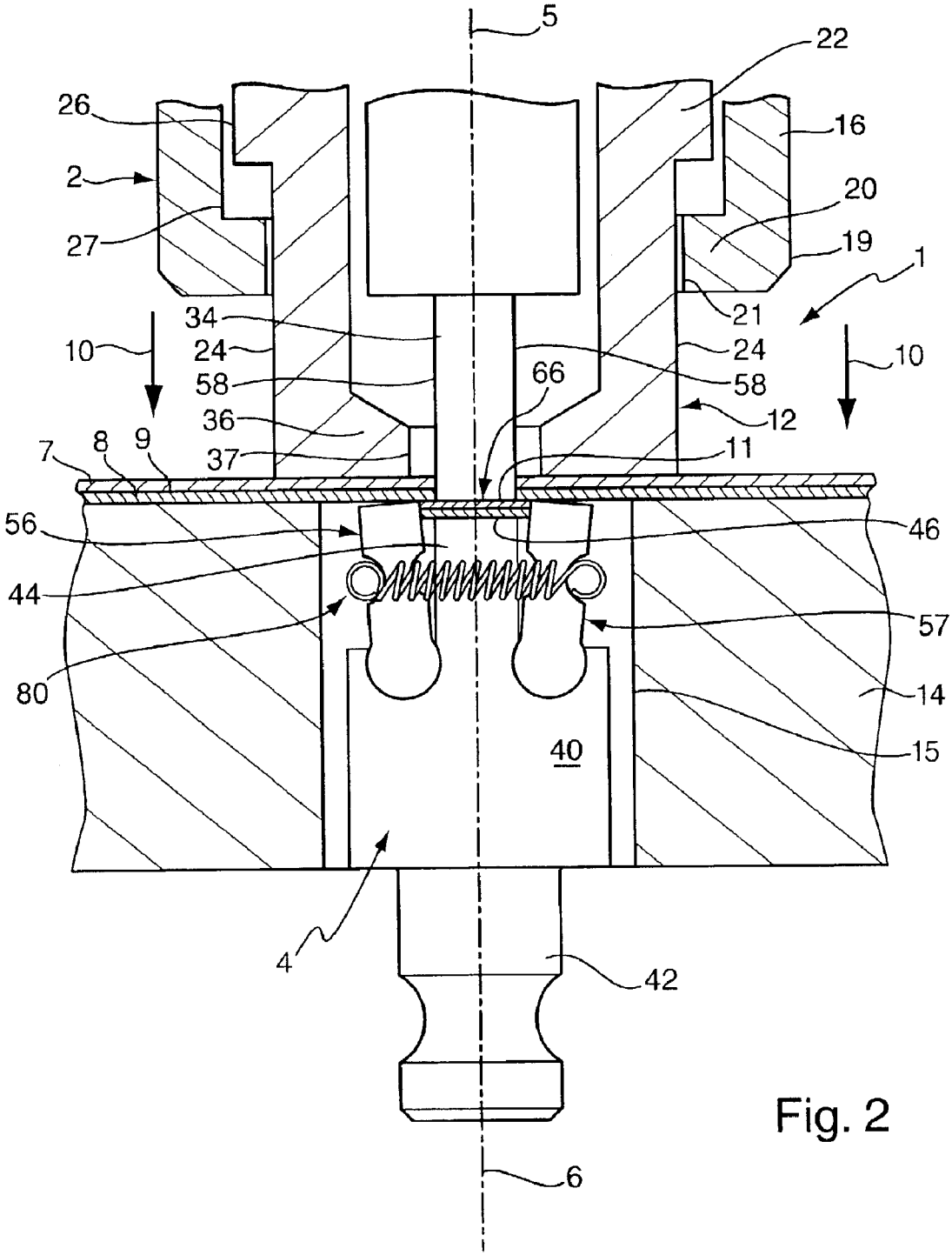
FIG. 2 is an enlarged partial cross section view of a part of FIG. 1, showing the punch tip and die in greater detail.
Figure 3:
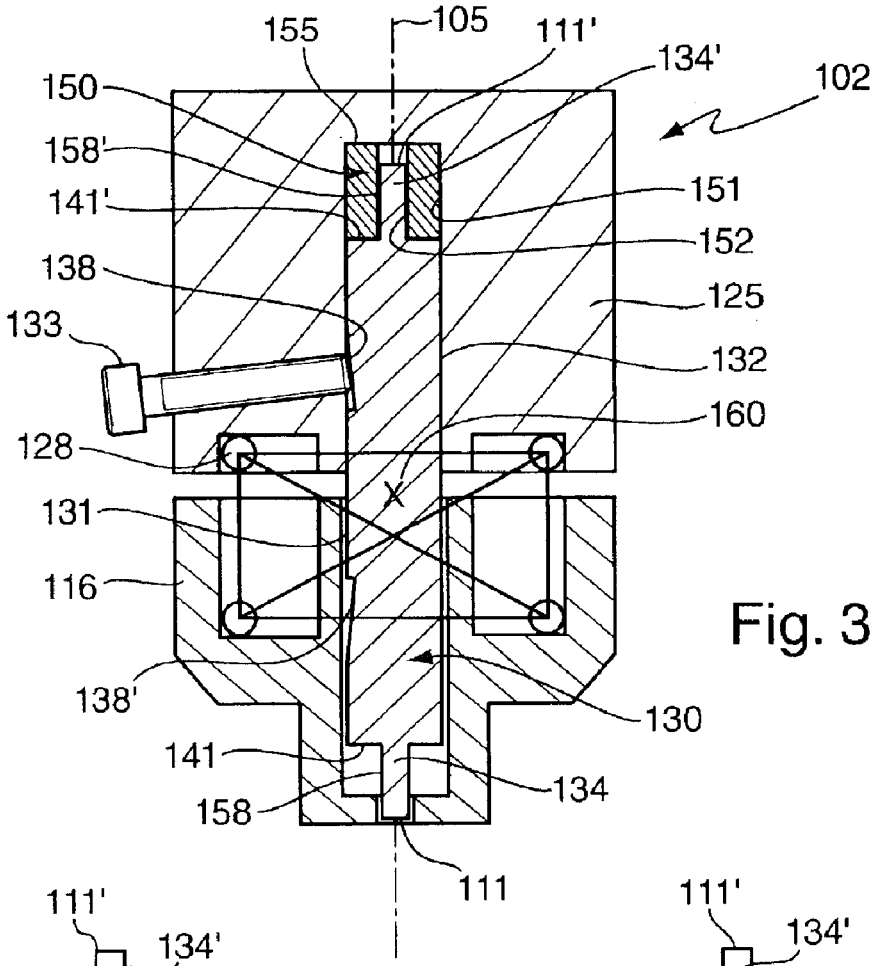
FIG. 3 is a simplified schematic representation of a part of a punch assembly according to a second embodiment of the invention, similar to that of FIG. 1, showing a double-ended punch with a cylindrical punch tip suitable for making a round clinch joint, secured within a punch holder.
Figure 4:
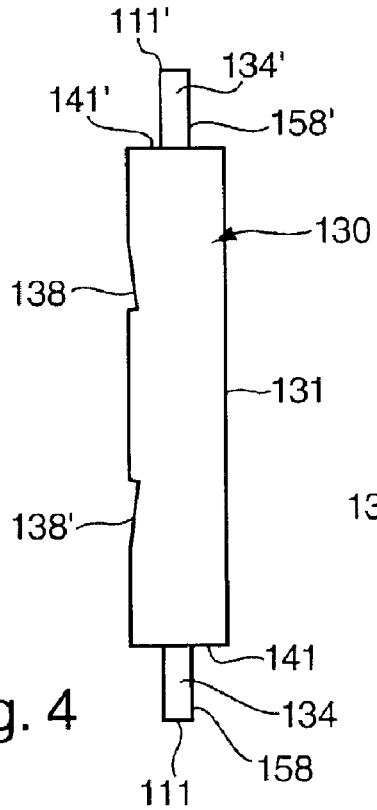
FIGS. 4, 5 and 6 are, respectively, two side views and an end view of the punch of FIG. 3.
Figure 6:
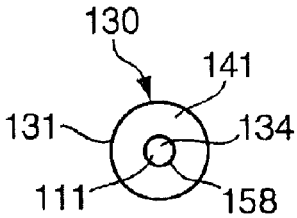
Figure 5:
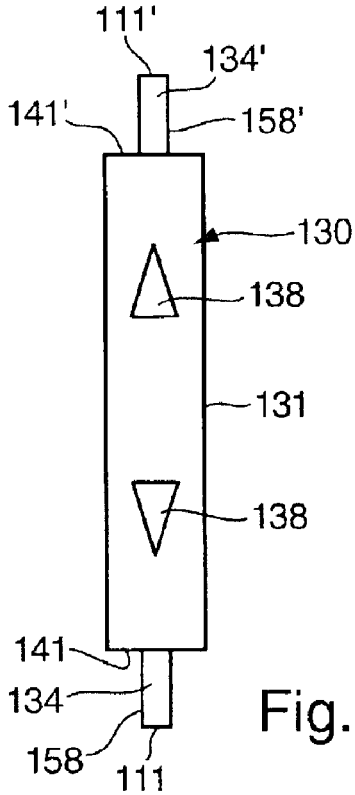

As shown most clearly in FIG. 2, the die assembly 4 has a unitary die body 40 which is rectangularly symmetric about the die axis 6. The die body 40 has at one end a lower stem 42 that in use is seated in a tool holder (not shown) to which the base plate 14 is also securely affixed. At the opposite end of the die body 40 is a die anvil 44 with a flat anvil surface 46.

A pair of die blades 56,57 are arranged either side of the die anvil 44, which has a similarly rectangular cross-section shape. Each die blade 56,57 extends longitudinally above and below the anvil surface 46 and forms with the anvil surface 46 a rectangular die aperture 66 for the punch tip 34.

The constricted rectangular die aperture 66 may be between 4 mm to 12 mm in length along a long axis, for example perpendicular to the drawing if FIG. 2, in which case the dimension of the recess 15 in the base plate 14 will be between, respectively, 8 mm to 18 mm. The width of the aperture 66 between the die blades 56,57 may then be between 2 mm to 8 mm. The depth of the aperture will depend on the separation between the die blades and thickness of sheet material to be joined, but typically will be between 0.5 mm to 2 mm. The die blades 56,57 are flush to 0.05 mm below the surrounding base plate 14, so that that the die blades may pivot outwards as the metal layers 7,8 are compressed by the punch tip 34 against the anvil surface.

The die blades 56,57 are biased against the die anvil 44 to constrict the die aperture 66 by a spring biasing means 80, seen most clearly in FIG. 2. The biasing means 80 are under tension even when the die blades 56,57 are against the die anvil 44.

The type of joint formed by the die tool 1 is a lanced type joint in which sheet material 7,8 is cut along two parallel lines formed by the scissor-like contact between each die blade and the punch tip 34. Compression of the ductile sheet materials 7,8 in the longitudinal direction into the die aperture 66 and against the anvil surface 46 by the die punch tip surface 11 causes the sheet materials 7,8 to shear and then to flow mainly in two opposite lateral directions towards each die blade 56,57. This flow causes the die blades 56,57 to be pushed outwards and the sheet materials 7,8 to flow underneath the cuts initially formed in the materials, in a process referred to as a "drawing process".

The forces involved in the drawing process will depend on the ductility of the material, but will usually be substantial, for example of the order of 1 tonne. This force is imparted from the flat end surface 55 of the punch bore 32 to the punch body 31 via the load spacer 50 and the shoulder 41'. In the terminology of the claims, the flat end surface 55 of the bore 32 is an example of a load application feature and the shoulder 41' is an example of a load engagement feature, the load being transmitted between the two by the load spacer 50. The load spacer protects the unused punch tip 34' from any damage or wear that might otherwise be caused by such forces if these forces were imparted via the unused punch tip 34'.

When the longitudinal pressure is relieved, the die punch tip 34 is withdrawn under the action of the coil spring 28 that was compressed in the drawing process. The punch tip 34 is then removed from the upper metal sheet 7, and at the same time the die 4 is removed from the lower metal sheet 8, whereupon each die blade 56,57 springs back against the die anvil 44 under the biasing action of the spring biasing means 80.

The cutting action will, over time, cause wear on the cutting die blades 56,57, which would then be replaced with new die blades. The punch tip will also become worn.

The invention permits the double-ended punch 30 to be reoriented so that the second punch tip 34' may be used. The set screw 23 is first removed, allowing the stripper can 16, stripper tip 12 and spring 28 to be separated form the punch 30 and punch holder 25. Then, the securing bolt 33 is loosened, allowing the punch 30 to be withdrawn from the punch holder 25. Because the punch is symmetric about a central point 60 on the punch axis 5, the second punch tip 34' can be oriented for use by inverting the punch 30 by 180° relative to the punch holder 25. The punch 30 is then reinserted into the punch holder 25 with a second flat 38' positioned so that when the securing bolt 33 is tightened, the punch 30 is secured within the holder 25 with the second punch tip 34' oriented for use. Finally, the stripper can 16, stripper tip 12 and spring are reassembled and reconnected to the punch 30 and punch holder 25.

FIGS. 3 to 6 show in a simplified schematic representation, a second embodiment 102 of the punch assembly in which components similar to those of the first embodiment 2 are indicated by reference numerals incremented by 100. Also shown schematically are other components of the punch assembly that work in the same manner as described above, in particular, the stripper assembly 116.

The second embodiment 102 differs from the first embodiment 2 in that the punch 130 has a pair of cylindrical punch tips 134,134', suitable for making a circular clinch joint in sheets of ductile material. Each shoulder 141,141' is therefore-annular in shape, and the load spacer 150 has cylindrical outer and inner surfaces 151,152.

Figure 7:
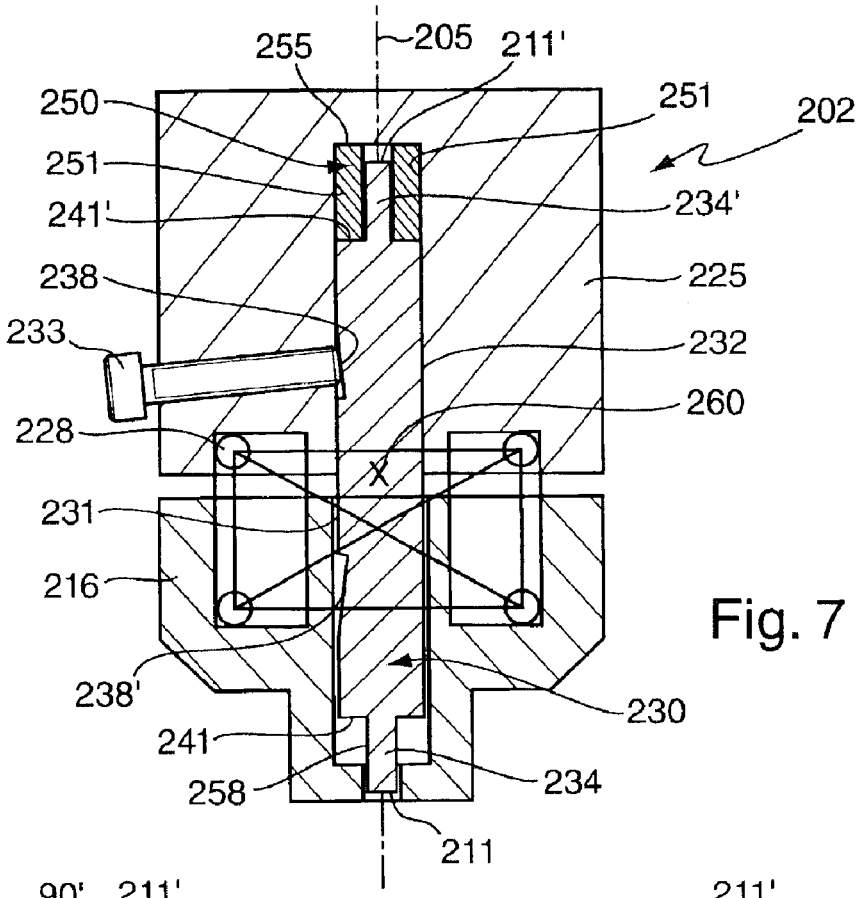
FIG. 7 is a simplified schematic representation similar to that of FIG. 3, showing a punch according to a third embodiment of the invention, showing a double-ended punch with a rectangular punch tip suitable for making a lanced joint, secured within a punch holder.
Figure 8:
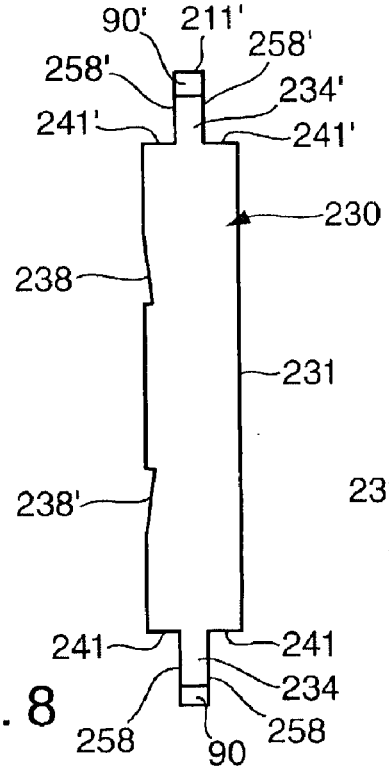
FIGS. 8, 9 and 10 are, respectively, two side views and an end view of the punch of FIG. 7.
Figure 10:
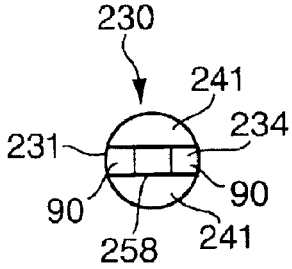
Figure 9:
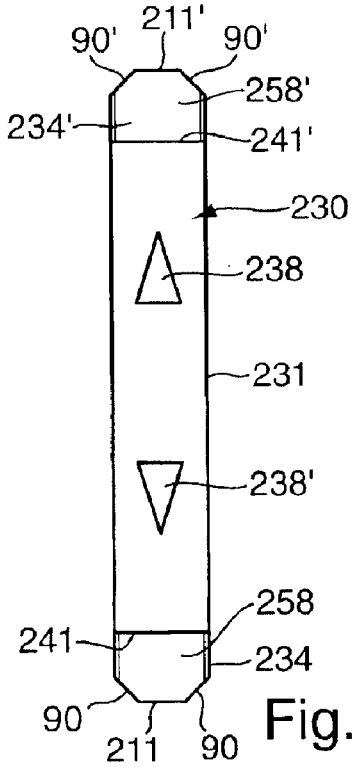

FIGS. 7 to 9 show in a simplified schematic representation, a third embodiment 202 of the punch assembly in which components similar to those of the first embodiment 2 are indicated by reference numerals incremented by 200. Also shown schematically are other components of the punch assembly that work in the same manner as described above, in particular, the stripper assembly 216.

The third embodiment 202 is similar to the first embodiment 2 in that each punch tip 234,234' is generally rectangular in a cross-section perpendicular to the punch axis 205. The punch tips 234,234' extend, however, in one direction fully to the cylindrical outer surface of the punch body 231. Each punch tip also has a pair of chamfered edges 90 either side of a nearly square punch surface 211,211'. This type of punch tip is well known in the art, and is suitable for making a trapezoidal lance joint. The double-ended punch 230 can be inverted to present a fresh punch tip 234' in the same way as described above.

Figure 11:
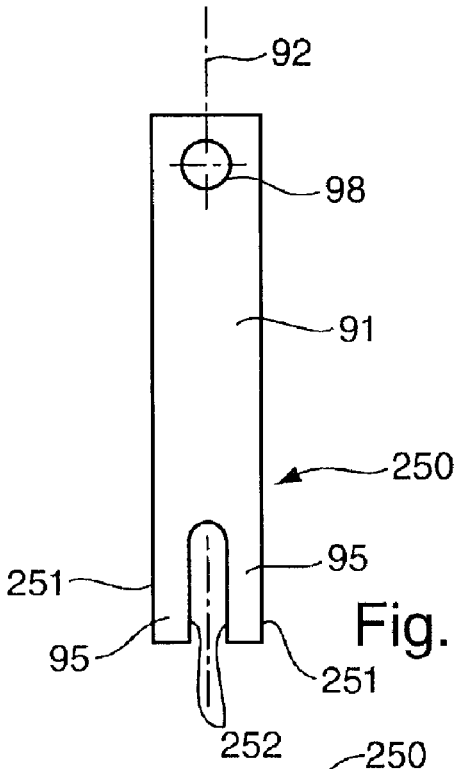
FIGS. 11, 12 and 13 are, respectively, two side views and an end view of a load spacer used to set the rotational orientation of the punch of FIG. 7.
Figure 12:
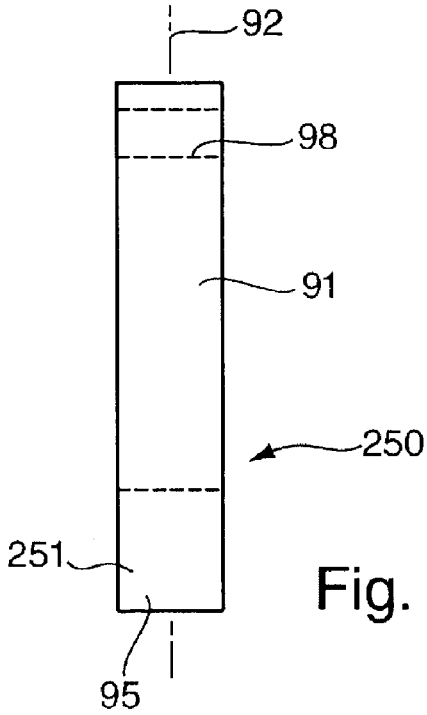
Figure 13:
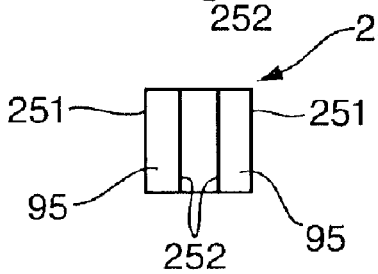

The main difference between the third embodiment 202 and the first embodiment 2 is the form of the load spacer 250, shown in more detail in FIGS. 11 to 13. Each shoulder 241,241' does not extend in a ring around the punch tip 234,234', but rather is formed in two separate halves each with a similar arcuate shape having one curved side truncated by a straight base. Because the bore 232 of the punch holder 225 is essentially cylindrical, it is not possible for the load spacer to extend fully around the concealed punch tip 234'. The punch holder therefore has an opening (not shown) that extends perpendicular to the plane of the drawing in FIG. 3 into the cylindrical bore 232, so that the load spacer 250 can be inserted into the bore 232 in a direction perpendicular to the punch axis 205.

As shown in FIGS. 11 to 13, the load spacer therefore has an elongate rectangular body 91 extending along an axis 92, and having a square or rectangular cross-section. A pair of similarly shaped rectangular fingers 95 extends axially from the load spacer body 91, spaced equidistantly on opposite sides of the axis 92. In use, the fingers 95 are inserted into the cylindrical bore 232 to serve as the load transmitting element between the punch holder 225 and punch shoulder 241,241'. The outer spacing of the finger 95 matches the inner spacing of the bore 232, and the inner spacing between the fingers 95 matches the width of the rectangular punch tip 234,234'. The benefit of this is that the load spacer 250 is rotationally aligned to the bore 232 about the punch axis 205, and each the punch tip 234,234' is aligned to the load spacer 250. This therefore sets the rotational orientation of the rectangular punch tip about the punch axis 205, and therefore helps to prevent misalignment between the punch tip 234,234' and a similarly shaped rectangular die aperture, such as the die aperture 66 shown in FIG. 2.

Alternatively, there may be some play between the load spacer outer surfaces 251 and the bore 232 so that the load spacer body 91 can be moved to rotate the load spacer 250 and hence punch 230 about the punch axis 205 in order to adjust the rotational orientation of the punch tip 234. In this case, the load spacer can be fixed in the correct orientation by a fixing bolt through an aperture 98 in the load spacer body 91.

As with the other embodiments, the longitudinal extent of the load spacer 250 can be altered, for example by grinding, in order to vary the position of the exposed punch tip 234, or the pressure exerted by the punch tip.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately, or in any suitable combination.

The punches 30,130,230 and punch assemblies 2,102,202 described above can each be used with suitable conventional die assemblies. The deformation process in making the joint in ductile material is unaffected by the invention, which can therefore readily be implemented in existing punch machinery. The double-ended punch also provides a significant cost saving compared with two separate punches, and can also help reduce the time needed to change a worn punch tip, owing to the fact that for half of such changes it is not necessary to locate or retrieve another punch. The invention therefore provides a convenient and economical punch for use in a tool for joining ductile materials.

It is to be appreciated that certain features of the invention, which are, for clarity, described in the context of separate embodiments, may also be provided in combination in a single embodiment. Conversely, various features of the invention which are, for brevity, described in the context of a single embodiment, may also be provided separately, or in any suitable combination.

It is to be recognized that various alterations, modifications, and/or additions may be introduced into the constructions and arrangements of parts described above without departing from the spirit or scope of the present invention, as defined by the appended claims.

What is claimed is:

1. A punch for use in a tool for joining ductile materials, comprising a punch body formed around a punch axis, two punch tips extending in opposite directions from the punch body along the punch axis, each punch tip having a punch surface that extends transversely to the punch axis, wherein said punch body has one or more load engagement features by which a punch force for joining ductile materials may be imparted to said punch body along said punch axis so that one or the other of the punch tips may bear against said ductile material without said punch force bearing on the opposite punch tip.

2. The punch of claim 1, in which the punch body has two of said load engagement features, a first one of said load engagement features being a first shoulder and a second one of said load engagement features being a second shoulder, said shoulders being arranged so that in use said punch force may be applied either to one of the said shoulders to cause the punch to exert a pressure or to move in a first direction along said punch axis, or to said other of said shoulders to cause said punch to exert a pressure or to move in a second direction along said punch axis.

3. The punch of claim 1, in which said punch body is substantially cylindrical about the punch axis.

4. The punch of claim 1, in which the punch tip is substantially cylindrical about the punch axis.

5. The punch of claim 1, in which said punch tip has a rectangular or square cross-section in a plane perpendicular to said punch axis.

6. The punch of claim 1, in which the punch is symmetric about a central point on the punch axis.

7. The punch of claim 1, in which said punch tips are unitary with said punch body.

8. The punch of claim 1, in which said load engagement feature is one or more shoulders on the punch body.

9. The punch of claim 8, in which the or each shoulder extends transversely to said punch axis.

10. The punch of claim 8, in which one of said shoulders defines a boundary between the punch body and one of said punch tips.

11. The punch of claim 10, in which said shoulder at said boundary extends in a ring around said punch tip.

12. A punch assembly for use in a tool for joining ductile materials, comprising a punch, and a punch holder to which said punch may be removably secured, in which said punch comprises a punch body formed around a punch axis, two punch tips extending in opposite directions from said punch body along said punch axis, each punch tip having a punch surface that extends transversely to said punch axis, wherein said punch body has one or more load engagement features by which a punch force for joining ductile materials may be imparted to said punch body along the punch axis so that one or the other of the punch tips may bear against said ductile material without said punch force bearing on the opposite punch tip, and said punch holder comprises a load application feature that in use imparts via the load engagement feature said punch force to the punch body along said punch axis, wherein said punch can be removably secured to said punch holder in either a first orientation or alternatively in a second orientation to dispose respectively one or the other of said punch tips for use to join ductile materials by application of said imparted punch force along said punch axis.

13. The punch assembly of claim 12, in which said punch when secured to the punch holder in said first orientation is 180° rotated with respect to said punch when secured to said punch holder in said second orientation.

14. The punch assembly of claim 12, in which said punch holder has a recess, and when said punch is secured to said punch holder in either said first orientation or said second orientation, one of said punch tips is retained within the recess while the other of said punch tips may be used to join ductile materials.

15. The punch assembly of claim 12, in which said assembly comprises a load spacer, said load spacer extending between said load engagement feature and said load application feature when said punch is secured to said punch holder.

16. The punch assembly of claim 15, in which said load engagement feature is a shoulder adjacent said punch tip within said recess, said punch tip having one or more side walls extending from said shoulder to said punch surface, and said load spacer having a clearance fit with said or each punch side wall.

17. The punch assembly of claim 16, in which said load spacer extends fully around said punch tip.

18. The punch assembly of claim 15, in which the load spacer has one or more location features that are located with one or more matching features of the punch so that the rotational orientation of the punch about the punch axis is determined by the rotational orientation of the load spacer.

19. The punch assembly of claim 18, in which the punch body has an essentially circular cross-section in a plane perpendicular to the punch axis such that prior to being secured to the punch holder, the punch may be rotated about the punch axis with respect to the punch holder, and at least one of the punch tips has a non-circular cross-section in a plane perpendicular to the punch axis, the orientation of said non-circular cross-section of the punch tip therefore being adjustable by rotating the punch about the punch axis prior to securing the punch in the punch holder.

20. The punch assembly of claim 18, in which the rotational orientation of the load spacer about the punch axis may be adjusted to make a corresponding adjustment to the rotational orientation of the punch.

21. The punch assembly of claim 20, which the load spacer has a projection that extends transverse to the punch axis to facilitate the making of said adjustment to the rotational orientation of the load spacer.

22. A ductile material joiner for joining two or more layers of ductile material, comprising a die and a punch assembly with a first punch tip and a second punch tip, one of said punch tips being disposed in use towards said die, wherein said die has a die aperture matching both punch tips, and said punch assembly comprises a punch, and a punch holder to which said punch may be removably secured, in which said punch comprises a punch body formed around a punch axis, said two punch tips extending in opposite directions from said punch body along said punch axis, each punch tip having a punch surface that extends transversely to said punch axis, wherein said punch body has one or more load engagement features by which a punch force for joining ductile materials may be imparted to said punch body along said punch axis so that one or the other of said punch tips may bear against said ductile material without said punch force bearing on the opposite punch tip, and said punch holder comprises a load application feature that in use imparts via said load engagement feature said punch force to the said punch body along said punch axis, wherein said punch can be removably secured to said punch holder in either a first orientation or alternatively in a second orientation to dispose respectively one or the other of said punch tips for use to join ductile materials by application of said imparted punch force along said punch axis.

23. The ductile material joiner of claim 22, in which the joiner is for making a round clinch joint or a lanced clinch joint.

24. A punch assembly for use in a tool for joining ductile materials, comprising:

a punch, said punch comprising:

a punch body formed around a punch axis; and two punch tips extending in opposite directions from said punch body along said punch axis, each punch tip having a punch surface that extends transversely to said punch axis, wherein said punch body has one or more load engagement features by which a punch force for joining ductile materials may be imparted to said punch body along said punch axis so that one or the other of said punch tips may bear against said ductile material without said punch force bearing on said opposite punch tip, and wherein said load engagement feature is a shoulder adjacent said punch tip within a recess, said punch tip having one or more side walls extending from said shoulder to said punch surface, and a load spacer having a clearance fit with said or each punch side wall; and a punch holder, to which the punch may be removably secured to said punch holder in either a first orientation or alternatively in a second orientation to dispose respectively one or the other of said punch tips for use to join ductile materials by application of said imparted punch force along said punch axis.

* * * * *